US009284818B2

(12) United States Patent
Hallundbæk et al.

(10) Patent No.: US 9,284,818 B2
(45) Date of Patent: Mar. 15, 2016

(54) DOWNHOLE TOOL FOR BOREHOLE CLEANING OR FOR MOVING FLUID IN A BOREHOLE

(75) Inventors: Jørgen Hallundbæk, Græsted (DK); Peter Gråbæk, Greve (DK)

(73) Assignee: WELLTEC A/S, Allerød (DK)

( * ) Notice: Subject to any disclaimer, the term of this patent is extended or adjusted under 35 U.S.C. 154(b) by 708 days.

(21) Appl. No.: 13/518,752

(22) PCT Filed: Dec. 23, 2010

(86) PCT No.: PCT/EP2010/070687

§ 371 (c)(1), (2), (4) Date: Jun. 22, 2012

(87) PCT Pub. No.: WO2011/076935

PCT Pub. Date: Jun. 30, 2011

(65) Prior Publication Data

US 2012/0255724 A1 Oct. 11, 2012

(30) Foreign Application Priority Data

Dec. 23, 2009 (EP) ..... 09180566

(51) Int. Cl.

| | |
|---|---|
| ***E21B 43/38*** | (2006.01) |
| ***E21B 37/00*** | (2006.01) |
| ***E21B 21/00*** | (2006.01) |
| ***E21B 43/12*** | (2006.01) |

(52) U.S. Cl.

CPC ..... *E21B 37/00* (2013.01); *E21B 21/002* (2013.01); *E21B 43/128* (2013.01)

(58) Field of Classification Search

CPC ..... E21B 21/00; E21B 21/002; E21B 27/005; E21B 31/03; E21B 37/00; E21B 43/38

USPC ..... 134/22.18; 137/15.16; 166/105.3, 311

See application file for complete search history.

(56) References Cited

U.S. PATENT DOCUMENTS

| | | | | |
|---|---|---|---|---|
| 2,916,091 | A * | 12/1959 | Caudill | 166/173 |
| 3,075,743 | A | 1/1963 | Sheets | |
| 3,267,869 | A * | 8/1966 | Vartapetov et al. | 415/190 |
| 6,547,003 | B1 * | 4/2003 | Bangash et al. | 166/106 |
| 6,595,295 | B1 | 7/2003 | Berry et al. | |
| 2001/0050173 | A1 | 12/2001 | Head | |
| 2004/0197187 | A1 | 10/2004 | Usab, Jr. et al. | |
| 2005/0186065 | A1 | 8/2005 | Wilson et al. | |
| 2008/0066920 | A1 * | 3/2008 | Allcorn et al. | 166/312 |
| 2009/0173501 | A1 | 7/2009 | Kotsonis et al. | |

FOREIGN PATENT DOCUMENTS

| | | | | |
|---|---|---|---|---|
| EP | 1852571 | | 11/2007 | |
| GB | 2335687 | A * | 9/1999 | E21B 37/00 |

OTHER PUBLICATIONS

International Search Report for PCT/EP2010/070687 mailed Jan. 31, 2011.

International Preliminary Report on Patentability dated Dec. 2, 2011.

* cited by examiner

*Primary Examiner* — Cathleen Hutchins
*Assistant Examiner* — Ronald Runyan
(74) *Attorney, Agent, or Firm* — Nixon & Vanderhye P.C.

(57) ABSTRACT

The present invention relates to a downhole tool (1) for borehole cleaning or for moving fluid in a borehole. The tool comprises a tool housing (29), a chamber inlet (6) and a chamber outlet (36), and the tool housing comprises a pump (8) arranged in a pump housing (4) and a driving unit powered by an electrical conducting means for driving the pump.

18 Claims, 7 Drawing Sheets

DOWNHOLE TOOL FOR BOREHOLE CLEANING OR FOR MOVING FLUID IN A BOREHOLE

This application is the U.S. national phase of International Application No. PCT/EP2010/070687 filed 23 Dec. 2010 which designated the U.S. and claims priority to EP 09180566.3 filed 23 Dec. 2009, the entire contents of each of which are hereby incorporated by reference.

FIELD OF THE INVENTION

The present invention relates to a downhole tool for borehole cleaning or for moving fluid in a borehole. The tool comprises a tool housing, a chamber inlet and a chamber outlet, and the tool housing comprises a pump arranged in a pump housing and a driving unit powered by an electrical conducting means for driving the pump.

BACKGROUND ART

Different operation tools for performing technical operations downhole, e.g. tools for milling and filtering, are known. These operations may take place in horizontal or vertical wells, or a deviation between the two.

A device for removing sand using the coiled tubing technique is known from U.S. Pat. No. 5,447,200. The device disclosed in this patent is used for removing high viscosity materials, such as sand and fluid mixed up with sand and other solid elements in a fluid. The sand or high viscosity fluid mixed with sand is pumped from the well to the surface in order to clean the sand out of the well. This is a very energy-consuming process. Furthermore, the device and method described in the patent are not suitable for combining with a filter unit in order to separate solids from liquids, as the device is only constructed for pumping the entire substance to the surface.

DESCRIPTION OF THE INVENTION

An aspect of the present invention is, at least partly, to overcome the disadvantages of the device mentioned above and to provide a tool which is suitable for moving low viscosity liquids from one area to another downhole, and a device which is suitable for combining with a filter unit to enable separation of sand and other debris from the low viscous fluid, and the debris in the filter unit is thereby collected while the liquid is expelled from a pump unit and remains in the borehole.

The above objects, together with numerous other objects, advantages, and features, which will become evident from the below description, are accomplished by a solution in accordance with the present invention by a downhole tool for borehole cleaning or for moving fluid in a borehole, the fluid comprising elements, such as solid or liquid materials and mixtures thereof present in the borehole, the tool comprising:

- a tool housing,
- a chamber inlet for letting fluid into the tool, and
- a chamber outlet for expelling solids or liquids or mixtures thereof, the tool housing comprising:
- a pump arranged in a pump housing, and
- a driving unit powered by an electrical conducting means for driving the pump,
- the pump being arranged between the chamber inlet and the chamber outlet, wherein the pump comprises at least one rotor unit rotating in relation to at least one stator unit and the pump is connected with the driving unit in order to rotate the rotor unit, causing the fluid to move from the chamber inlet towards the chamber outlet.

The pump unit and the driving unit for driving the pump being placed close to each other in the borehole makes expensive and energy-consuming transport of the operating energy to the operating pump unnecessary. Furthermore, since the inlet and the outlet are placed on either side of the rotor/stator arrangement (i.e. a turbine pump or an axial compression pump), the liquid with or without sand and/or debris is moved a certain, suitable distance in the borehole. Finally, since the pump is constructed in accordance with a rotor/stator principle, the accumulated pressure is limited compared to other pumps, e.g. a screw pump, and the pump forms a suction effect on the inside of the pump housing. For this reason as well, much less power is needed for driving the pump than with known comparable technology.

In an embodiment, the rotor unit may comprise at least one rotor blade having a hydrodynamic profile having a leading edge and a trailing edge.

This leads to a more even flow along the entire length of the profile, which makes the pump more efficient.

Furthermore, the rotor unit may comprise at least one rotor blade having an increasing or decreasing cross-sectional thickness.

Moreover, the stator unit may comprise at least one stator blade having a hydrodynamic profile having a leading and a trailing edge.

In one embodiment, the profile may taper towards the leading edge and the trailing edge.

Additionally, the profile may have a curving camber line.

Moreover, the profile may have a thickness decreasing towards the trailing edge.

Furthermore, the profile may be an airfoil profile.

The airfoil profile may have a shape of a National Advisory Committee for aeronautics ("NACA") profile. The shape of such a NACA airfoil is described using a series of digits following the word "NACA." The parameters in the numerical code can be entered into equations to precisely generate the cross-section of the airfoil and calculate its properties.

In an embodiment, the rotor unit may comprise at least one rotor blade, the rotor blade having a first rotor surface and a second rotor surface, the first rotor surface being convex.

Furthermore, the rotor unit may comprise at least one rotor blade, the rotor blade having a first rotor surface and a second rotor surface, the second rotor surface being concave.

Also, the stator unit may comprise at least one stator blade, the stator blade having a first stator surface and a second stator surface, the first stator surface being convex.

Moreover, the stator unit may comprise at least one stator blade, the stator blade having a first stator surface and a second stator surface, the second stator surface being concave.

In another embodiment, the rotor unit may comprise at least one rotor blade, the rotor blade having a first rotor surface and a second rotor surface, the first rotor surface being a convex surface pointing in the direction of the chamber inlet.

The stator unit may comprise at least one stator blade, the stator blade having a first stator surface and a second stator surface, the first stator surface being a convex surface pointing in the direction of the chamber inlet.

Furthermore, the rotor unit may comprise at least one rotor blade, the rotor blade having a first rotor surface and a second rotor surface, the second rotor surface being a concave surface pointing in the direction of the chamber outlet.

In this way, smooth guidance of the fluid is secured and turbulence is avoided.

Moreover, the tool may have a tool axis, the rotor unit may comprise at least one rotor blade, and the stator unit may comprise at least one stator blade, the rotor blade may be angled at an angle in relation to the tool axis.

In an embodiment of the invention, the tool may have a tool axis, the rotor unit may comprise at least one rotor blade, and the stator unit may comprise at least one stator blade, and the rotor blade may be angled at an angle in relation to the tool axis in the opposite direction of the rotation direction, and the stator blade may be angled at an angle in relation to the tool axis in the rotation direction.

The fluid is captured in one end of the rotor blade and forced along the rotor surface and captured by the stator blade, and the fluid is thus forced forward in a zig-zag pattern.

The pump may have a pump inlet end which is in fluid communication with the chamber inlet and is shaped as a central channel being diverted into a circumferential annular channel.

Furthermore, the number of blades in each stator unit and in each rotor unit may be the same.

Additionally, the stator unit(s) may be connected to the pump housing and be held stationary in relation to the shaft.

The pump housing may have at least one opening into which part of the stator unit projects.

Moreover, the rotor and stator units may be arranged on a rotatable shaft, the shaft being connected with and driven by the driving unit at a first end and being unconnected and suspended from the driving unit at a second end.

In one embodiment, the inlet may be connected to a fluid cleaner device comprising means for separating a material, such as debris and formation pieces, from a liquid.

In another embodiment, the fluid cleaner device may comprise a cleaner housing connected to the tool housing, the cleaner housing comprising a collecting chamber and the means for separating the material from the liquid, such as a filter, being arranged within the collecting chamber.

The cleaner housing may comprise a second inlet and a second outlet, the second outlet guiding the fluid into the collecting chamber and being in fluid communication with an annular channel.

In yet another embodiment, the stator unit may comprise at least one stator blade, the stator blade having a first V surface and a second V surface, the second stator surface being a concave surface pointing in the direction of the chamber outlet.

The blades may taper towards the inlet and/or the outlet.

The tool may comprise a plurality of rotor blades and a plurality of stator blades.

Furthermore, the tool may comprise a plurality of rotor units and a plurality of stator units.

In one embodiment, a journal bearing may be provided between the stator unit and the shaft.

In another embodiment, the blades may extend radially outwards towards the pump housing.

In yet another embodiment, the circumferential annular channel may be smaller than the central channel.

The convex surface(s) of the rotor unit(s) and the convex surface of the stator unit(s) point towards each other.

The housing may be liquid-tight and resistant to a pressure of at least 2 bar.

Furthermore, the rotatable shaft may be supported by supporting units at the end near the driving unit.

The tool according to the invention may further comprise a valve unit for catching the elements and a guiding means for guiding the elements and liquids to the fluid cleaner device, the valve unit being placed in relation to the fluid cleaner device.

In another embodiment, the pump may be a turbine pump.

In addition, the tool may further comprise a driving tool, such as a downhole tractor, for moving the tool forward in the casing.

The invention further relates to the use of a tool in combination with a driving unit, such as a downhole tractor.

Finally, the invention relates to the use of a tool in a horizontal borehole and deviations thereof in a range of +/−45°.

BRIEF DESCRIPTION OF THE DRAWINGS

The invention and its many advantages will be described in more detail below with reference to the accompanying schematic drawings, which for the purpose of illustration show some non-limiting embodiments and in which.

DETAILED DESCRIPTION OF THE INVENTION

Figure 1:
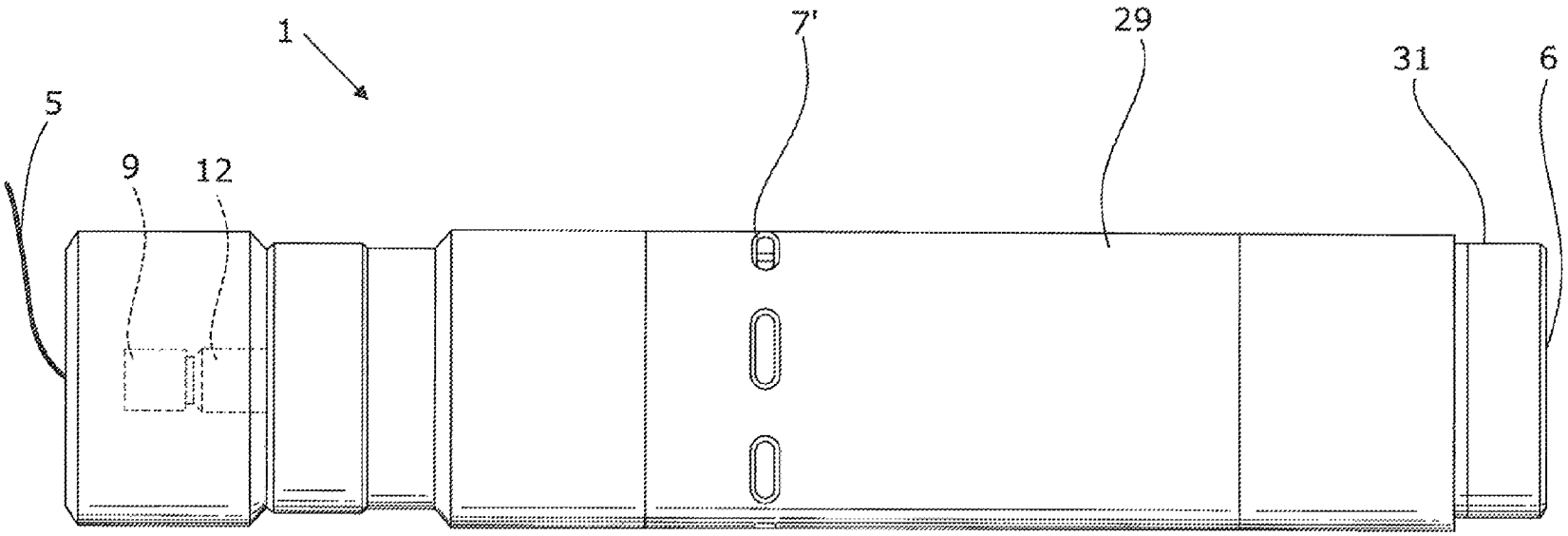
FIG. 1 shows an outside view of a tool according to invention.
Figure 1A:
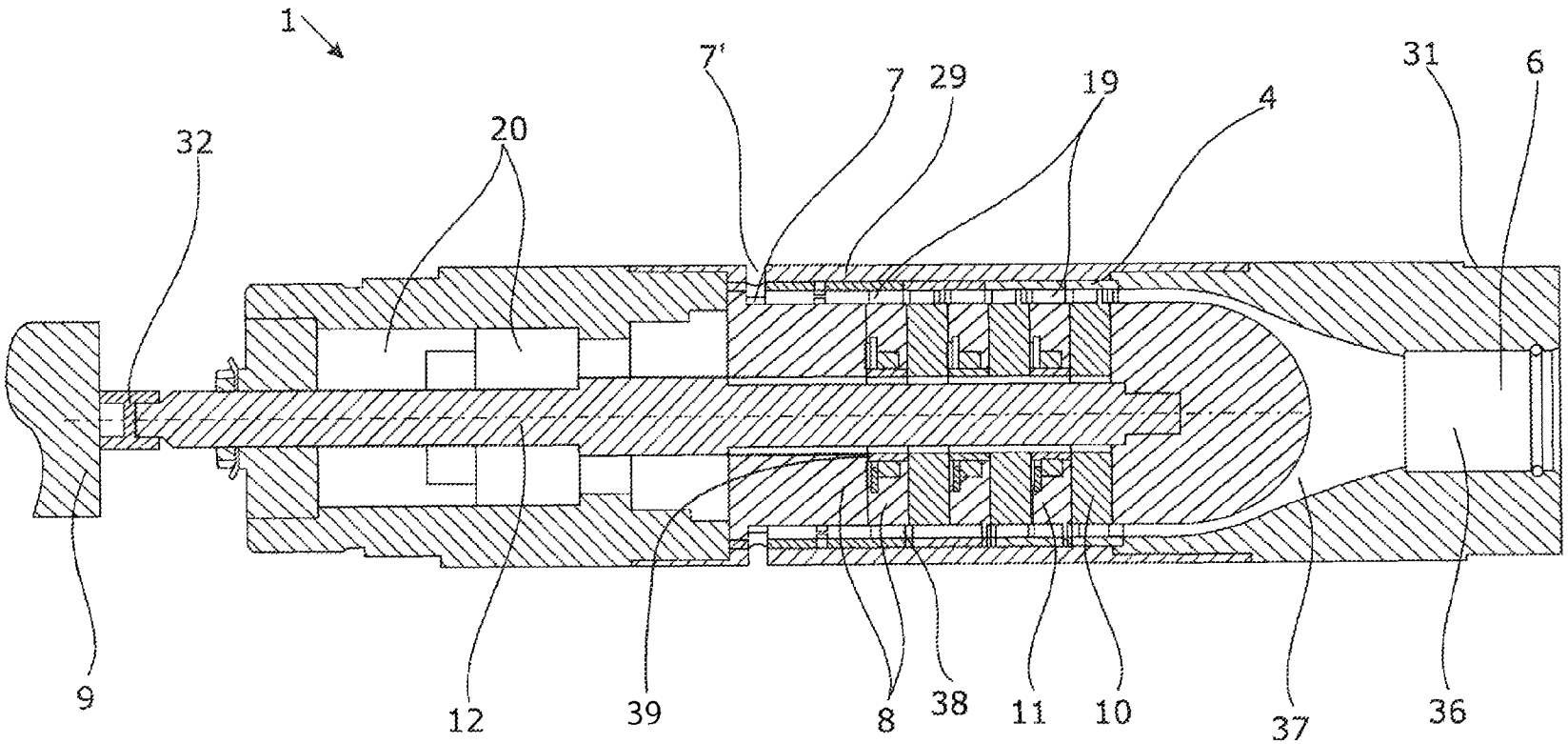
FIG. 1*a* shows a cross-section through the tool on line A-A of FIG. 1.

FIGS. 1 and 1*a* show a downhole tool 1 comprising a tool housing 29 inside which a rotor/stator pump 8 is arranged. The rotor/stator pump 8 could be a turbine pump or a compression pump. In the tool housing 29, a plurality of openings 7' is provided for allowing the fluid to enter the tool 1 or be expelled during use of the pump 8. A rotatable shaft 12 is placed centrally between the tool housing 29 and the pump 8 and is connected to a driving unit 9 by means of the shaft. The driving unit could be an electrical motor being powered by an electrical conducting means 5, such as a wireline.

By having a pump 8 with rotor and stator units driven by a submergible driving unit 9, a very energy-efficient pump is provided which is able to move fluid in a horizontal part of a well. The driving unit 9 and the pump 8 are easily submerged into the well and are easily retrieved by pulling the wireline.

In the other end of the downhole tool 1, opposite the motor 9, a connecting part 31 is arranged for connecting the tool 1 to a helping tool, such as a fluid cleaner device 21 or a milling device. The fluid comprising elements handled by the pump 8 is sucked into the chamber inlet 6 and continues into the rotor unit 10 and the stator unit 11, which will be explained in the following, referring explicitly to FIG. 1*a*.

FIG. 1*a* shows the rotatable shaft 12 placed in the middle of the construction, providing a central axis, and in one end being connected to a coupling bushing 32. This bushing 32 provides a connection between the driving unit 9 and the pump 8. The shaft 12 is supported by a supporting unit 20, such as ball bearings, in the end where the bushing 32 is arranged. The shaft 12 may also be supported in the opposite end by a further ball bearing or a journal bearing in order to avoid imbalance.

In the end opposite the bushing 32 of the rotatable shaft 12, the pump 8 is arranged. The pump 8 comprises a pump housing 4 and at least one stator unit 11 and one rotor unit 10 surrounded by the pump housing 4, and the rotor unit 10 is connected to the rotatable shaft 12, following the rotation of the shaft. The rotor unit 10 comprises several rotor blades 13 which are placed concentrically around the shaft 12 and extend radially outwards towards the pump housing 4. The stator unit 11 also comprises several stator blades 16 arranged around the shaft 12.

Advantageously, there could be three rotor units 10, each rotor unit working together with one stator unit 11, causing the number of stator units 11 to be the same as the number of rotor units 10. However, there could also be more stator/rotor units 10, 11 depending on the distance which the fluid is to be moved and thus on how much pump effect is needed. The stator units 11 are immovable as they maintain the same stationary relation to the pump housing 4 during the rotation of the shaft 12. The stator blades 16 are maintained stationary by their connection with the pump housing 4 in the end, pointing radially outwards. Preferably, the stator blades 16 are constructed in such a way that the end pointing towards the centre of the axis is secured on a slide ring 39 surrounding the shaft 12. Each stator blade 16 is preferably radially configured with a small fin 38 which is engaged with an opening 40 in the pump housing 4. The interaction between the fin 38 and the opening 40 prevents the fin from moving, and due to the slide ring 39, the shaft 12 rotates in relation to the stator blades 16 which remain immovable and stationary.

The stator units 11 are placed in the same way as the rotor units 10 so that they are concentrically positioned in relation to the rotatable shaft 12, and the blades 16 extend radially outwards towards the pump housing 4.

Between the stator unit 11 and rotor unit 10 and the circumferential pump housing 4, an annular chamber 19 is created. This annular chamber 19 functions as a passage for the fluid being sucked into the pump 4 through a chamber inlet 6 and further into the pump inlet 36. From the inlet, the fluid is directed into a central channel 37. This central channel 37 constitutes the fluid connection between the pump inlet 36 and the annular channel 19. The outer walls of the central channel 37 preferably diverge towards the annular chamber 19, and the inner wall is formed by the suspension of the shaft 12.

The cross-sectional area of the central channel 37 is smaller than that of the central chamber, preferably in the relation interval of 20:1 to 2:1. By reducing of the cross-sectional area, the pressure caused by the pump 4 is increased.

The rotation of the rotor blades 13 causes the fluid to be transported along the sidewalls of the annular chamber 19 until it is expelled through the chamber outlets 7 and the openings 7' of the tool housing 29.

Figure 2:
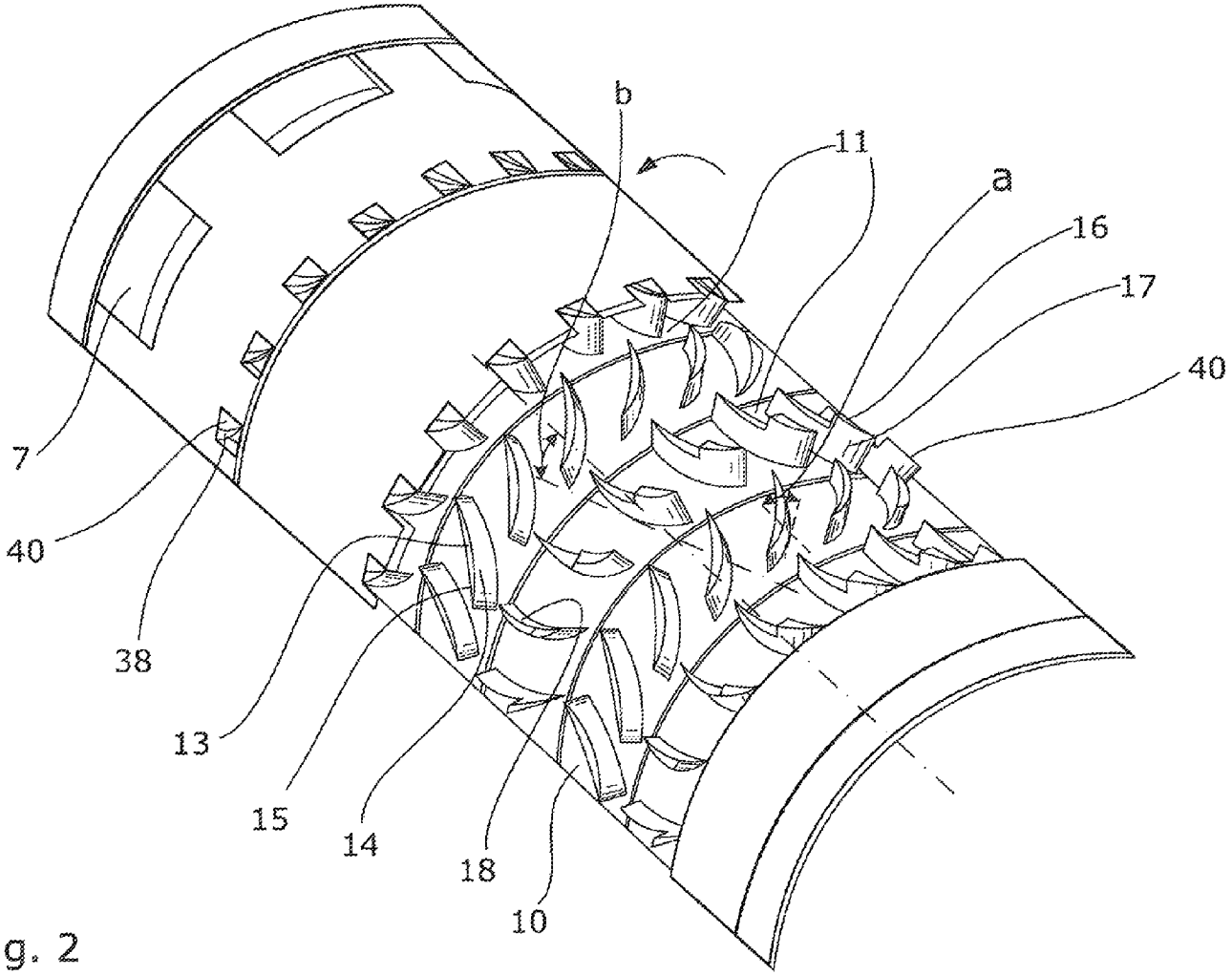
FIG. 2 shows a section of the pump according to the invention and the relation between the stator and the rotor.

FIG. 2 shows the rotor units 10 and stator units 11 in detail. Every single stator unit 11 and rotor unit 10 comprises 20-25 blades 13, 16. However, this number could also be larger or smaller. The blades 13, 16 are constructed and arranged in such a way that a first surface 14 of both the rotor blade 13 and the stator blade 16 is convex, these convex surfaces all pointing towards the inlet opening 6 of the tool 1. The convex surfaces of the rotor units 10 point in the opposite direction than the direction of the rotation of the shaft 12. The rotation direction is shown with an arrow in FIG. 2. The convex surfaces of the stator units 11 point in the same direction as the direction of the rotation of the shaft 12.

Each blade 13, 16 has a second surface 15, 18 opposite the first surface 14, 17, pointing towards the outlet opening 7. The second surfaces 15, 18 of the rotor blades 13 are concave, and as the shaft 12 rotates counter clock wisely, the fluid is pushed towards the outlet opening 7 by the concave surface and passes through the channels of the stator blades 16. The channels are formed between the first surface 17 of a stator blade 16 and the second surface 18 of the neighbouring stator blade. The second surfaces 18 of the stator blades 16 are also concave.

The angle b between the tool axis, also being the rotation axis of the shaft 12, and the tangent in the middle of the convex surface of the stator blade is between 20 and 60°. The angle a between the tool axis/rotation axis and the tangent in the middle of the convex surface of the rotor blade is 25-65°, preferably 35-55°.

Typically, three stator units 11 and three rotor units 10 are required to create a sufficient flow through the rotor chamber. However, this number could be larger or smaller. The pressure in the pump 4 is typically below 2 bar, and the pump and the tool 1 are therefore especially advantageous for pumping and removing fluid in horizontal boreholes and deviations thereof. However, it is also possible to use the tool 1 for vertical boreholes and deviations thereof (typically 10-30°).

Figure 3:
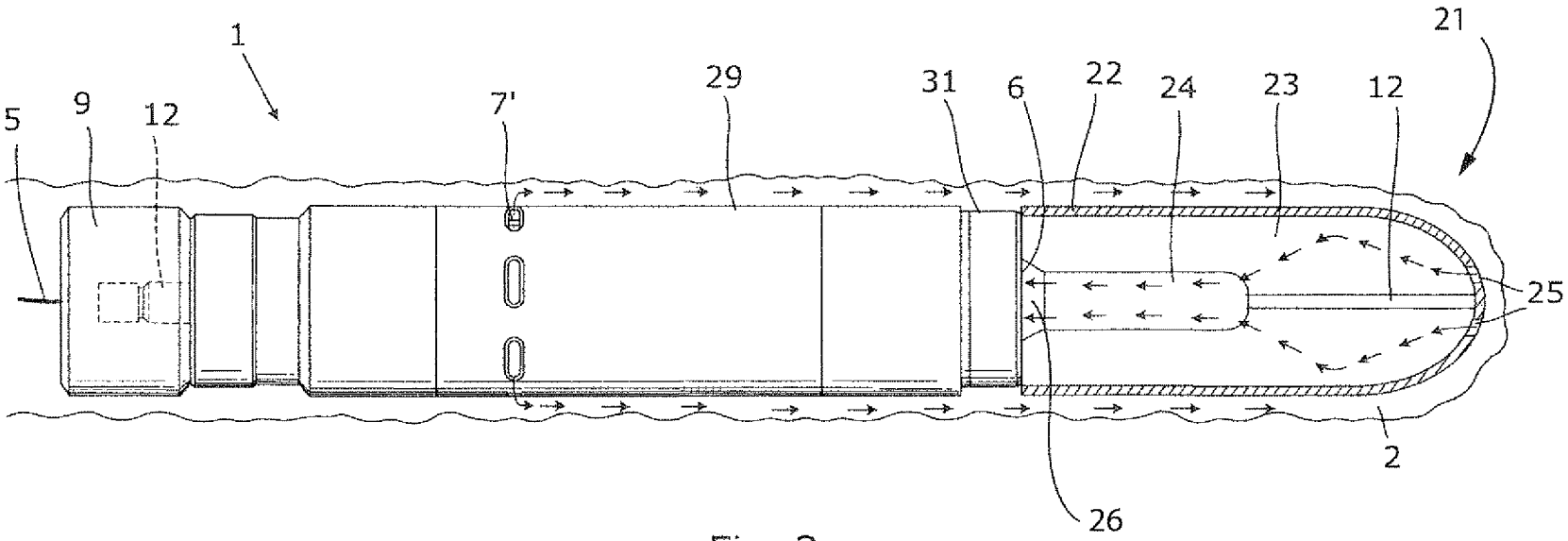
FIG. 3 shows a sectional view of a filter which may advantageously be used and be connected to the pump according to the invention.

FIG. 3 shows a fluid cleaner device 21, which is a tool that could be connected to the connection parts 31 of the pump 8. This device 21 comprises a cleaner housing 22 surrounding a collecting chamber 23, and in the middle of this collecting chamber 23, a filter 24 is placed. Fluid or debris or other substances, such as sand, pipe dope, remains from a previous explosion, rust from the casing in the well or detachments torn off the well, are sucked into the chamber 23 through a second inlet 25 arranged at the front of the cleaner housing 22. Due to the suction of the pump 8 which is connected to the filter 24 through its inlet opening 6, the fluid is sucked through the opening of the filter 24 and into a second outlet 26 of the fluid cleaner device 21 and further into the inlet 6. From here, it continues to the pump inlet 36 and on to the central channel 37 and further into the annular channel 19, letting the downhole tool 1 through the openings 7.

This pumping and suction occur due to the rotation of the rotor units 10, creating a low pressure causing sand and other solid elements to be accumulated outside the filter 14 and inside the connecting chamber, meaning that only the fluid as such is sucked into the filter 24 and passes through the rotor and stator unit arrangement. Such a filter device 24 is known from WO 2008/104177 which is incorporated by reference.

Figure 4:
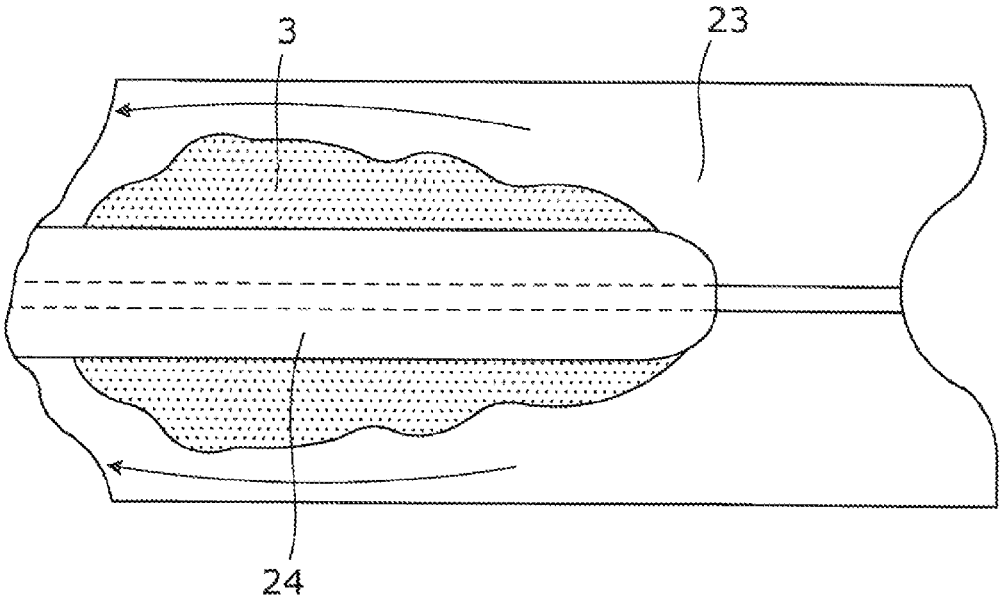
FIG. 4 shows a section of the filter shown in FIG. 3 and indicates how the solid material is positioned due to the suction of the pump.

In this construction, the filter 24 is designed as an elongated member and is arranged so that it extends along the centre axis of the chamber. The debris and formation pieces which have been separated from the fluid by the filter 24 are collected by the chamber and placed in the cavity between the filter and the inside of the chamber, as shown in FIG. 4.

In continuation of this fluid cleaner 21, a sort of whisk 34 could be placed. This whisk 34 ensures that the fluid is directed into the opening of the fluid cleaner device 21 and further into the pump 4. The fluid leaving the pump 4 through the outlet openings 7' is cleaned for solid material, causing water and other liquids to remain downhole. This has the advantage that it is not necessary to fill further liquid/water into the downhole to obtain and maintain the correct pressure. When the cleaning unit is full, the entire device 21 can be pulled to the surface, and the tool 1 can be emptied.

The tool 1 according to the invention is typically operated by a driving tool, such as a downhole tractor, for moving the tool forward in the well.

Figure 5:
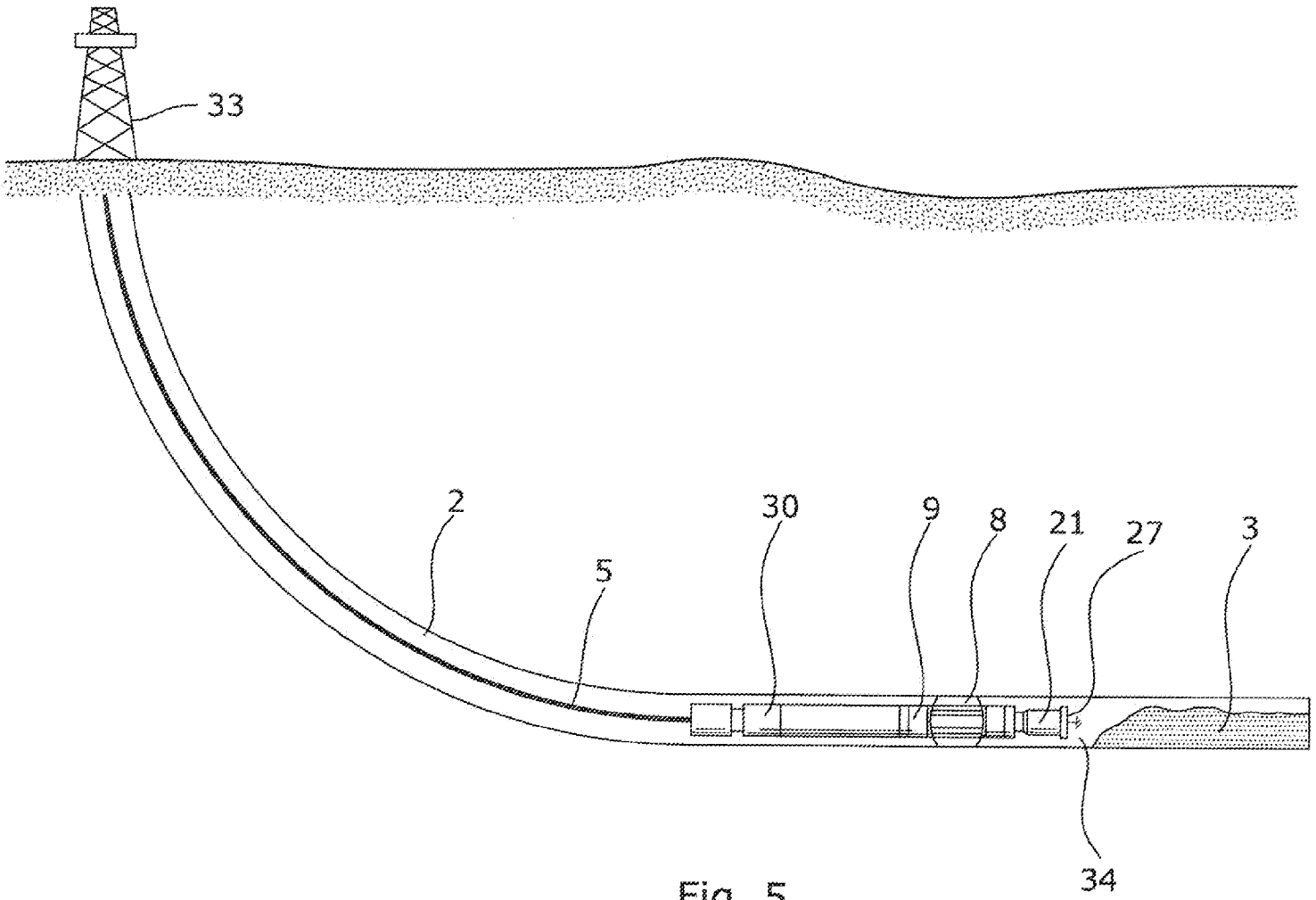
FIG. 5 shows a schematic view of a tool according to the invention, connected to a tractor, bearing a tool, e.g. a filter, and placed downhole.

FIG. 5 shows a principle drawing of this arrangement, showing a tool 1 according to the invention placed in a borehole 2. In front of this, a fluid cleaner device 21 is connected, and a valve unit 27 and a whisk 34 are placed in order to guide the fluids mixed up with debris etc. into the pump 4. Opposite the fluid cleaner device 21, the pump 4 is connected to a driving unit 9, such as a motor, and all these units are driven by a tractor 30. This tractor 30 is supplied with energy from a wireline. The wireline is connected to a power supply, e.g. an oil rig 33, situated above the surface. This power supply also supplies the tool 1 according to the invention.

Figure 6:
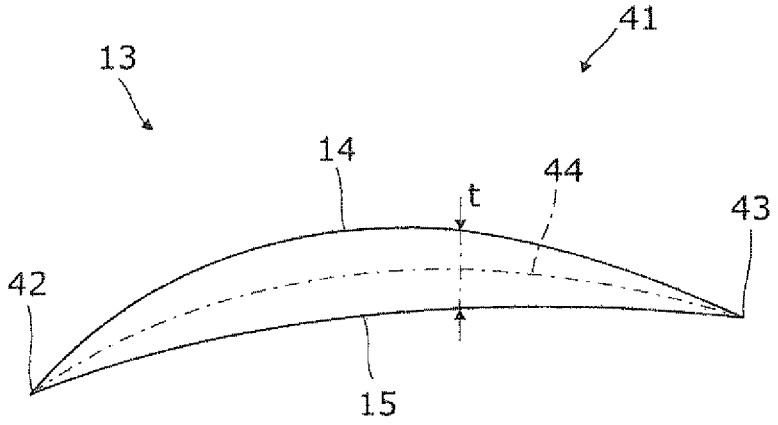
FIG. 6 shows the rotor blade seen from one end.

FIG. 6 shows a rotor blade 13 having a hydrodynamic profile 41. The hydrodynamic profile 41 has a leading edge 42 and a trailing edge 43. The profile is seen from the side of the tool of FIG. 2 and extends radially towards the centre of the tool 1. As can be seen, the profile 41 tapers towards both the leading edge 42 and the trailing edge 43, respectively, resulting in the fluid in the pump being attacked in a line instead of in a plane or face. Thus, the rotor blade 13 has a cross-sectional thickness increasing from the leading edge 42 towards the middle part of the blade and a cross-sectional thickness t decreasing from the middle part towards the trailing edge 43. The profile 41 has a curving camber line 44 causing the profile to be convex at its first surface 14 and concave at its second surface 15. The shape of the profile 41 causes the fluid to flow more evenly across the entire length of the profile, which results in a more efficient pump.

Figure 7:
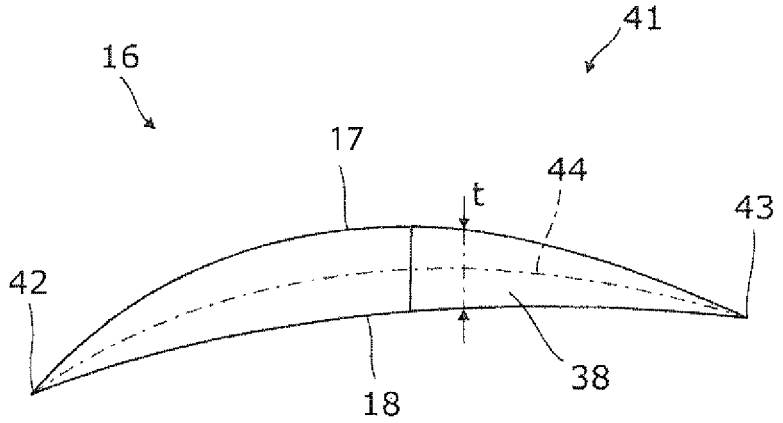
FIG. 7 shows the stator blade seen from one end.

In FIG. 7, the stator blade 6 is shown having the same hydrodynamic profile 41 as the rotor blade of FIG. 6. The profile 41 also has a curving camber line causing the profile to be convex at its first surface 17 and concave at its second surface 18. The shape of the profile 41 causes the fluid to flow more evenly across the entire length of the profile, which results in a more efficient pump. The stator blade 16 has a small fin 38 which extends from the blade into an opening in the tool 1 or pump housing 4 so as to hinder it from rotating.

The profiles of FIGS. 6 and 7 are airfoil profiles. In another embodiment, the airfoil profile has the shape of a NACA profile.

In the event that the tool 1 according to the invention is not submergible all the way into the casing, a downhole tractor can be used to draw or push a pump system all the way into position in the valve. A downhole tractor is any kind of driving tool able to push or pull tools in a valve downhole, such as a Well Tractor®.

Within the scope of the invention, the fluid and elements 3 may be any kind of downhole fluid, such as oil, water, a mix of oil and water gas or the like.

| | |
|---|---|
| 1 | downhole tool |
| 2 | borehole |
| 3 | elements |
| 4 | pump housing |
| 5 | electrical conducting means/wireline |
| 6 | chamber inlet |
| 7 | chamber outlet |
| 7' | openings |
| 8 | pump |
| 9 | driving unit |
| 10 | rotor unit |
| 11 | stator unit |
| 12 | rotary shaft |
| 13 | rotor blade |
| 14 | first rotor surface |
| 15 | second rotor surface |
| 16 | stator blade |
| 17 | first stator surface |
| 18 | second stator surface |
| 19 | annular channel |
| 20 | supporting units |
| 21 | fluid cleaner device |
| 22 | cleaner housing |
| 23 | collecting chamber |
| 24 | filter |

-continued

| | |
|---|---|
| 25 | second inlets |
| 26 | second outlets |
| 27 | valve unit |
| 28 | guiding means |
| 29 | tool housing |
| 30 | tractor |
| 31 | connection part |
| 32 | coupling bushing |
| 33 | rig |
| 34 | whisk |
| 35 | tool axe |
| 36 | pump inlet |
| 37 | central channel |
| 38 | small fin |
| 39 | slide ring |
| 40 | opening |
| 41 | profile |
| 42 | leading edge |
| 43 | trailing edge |

The invention claimed is:

1. A downhole tool for borehole cleaning or for moving fluid in a borehole, the fluid comprising elements, the elements including solid materials, liquid materials or mixtures thereof present in the borehole, the tool comprising:

a chamber inlet configured to let fluid into the tool;

a chamber outlet configured to expel solids or liquids or mixtures thereof; and a tool housing, the tool housing comprising:

a pump arranged in a pump housing, and a driving unit powered by an electrical power source, the driving unit being configured to drive the pump, the pump being arranged between the chamber inlet and the chamber outlet;

wherein the pump comprises at least one rotor unit comprising a plurality of rotor blades having a hydrodynamic profile having a leading edge and a trailing edge, and at least one stator unit comprises a plurality of stator blades having a hydrodynamic profile having a leading and a trailing edge, the at least one rotor unit rotates in relation to the at least one stator unit and the pump is connected with the driving unit in order to rotate the rotor unit, causing the fluid to move from the chamber inlet towards the chamber outlet;

wherein each of the plurality of stator blades has a convex surface arranged such that a chord connecting a leading edge of a respective stator blade with a trailing edge of the respective stator blade is arranged in a non-parallel relationship to a longitudinal axis of the tool; and wherein the chamber outlet is configured to expel at least the liquids admitted to the tool through the chamber inlet into the surrounding borehole in which the downhole tool is located.

2. The downhole tool according to claim 1, wherein the hydrodynamic profile of the rotor blades and the hydrodynamic profile of the stator blades tapers towards the leading edge and the trailing edge.

3. The downhole tool according to claim 1 wherein the hydrodynamic profile of the rotor blades and the hydrodynamic profile of the stator blades have a curving camber line.

4. The downhole tool according to claim 1, wherein the hydrodynamic profile of the rotor blades and the hydrodynamic profile of the stator blades have a thickness decreasing towards the trailing edge.

5. The downhole tool according to claim 1, wherein the hydrodynamic profile of the rotor blades and the hydrodynamic profile of the stator blades comprise an airfoil profile.

6. The downhole tool according to claim 5, wherein the airfoil profile has a shape of a National Advisory Committee for Aeronautics (NACA) profile.

7. The downhole tool according to claim 1, wherein the rotor unit comprises at least one rotor blade, the rotor blade having a first rotor surface and a second rotor surface, the first rotor surface being convex.

8. The downhole tool according to claim 1, wherein the rotor unit comprises at least one rotor blade, the rotor blade having a first rotor surface and a second rotor surface, the second rotor surface being concave.

9. The downhole tool according to claim 1, wherein the tool has a tool axis, the rotor unit comprises at least one rotor blade, and the stator unit comprises at least one stator blade, and wherein the rotor blade is angled at an angle in relation to the tool axis.

10. The downhole tool according to claim 1, wherein the number of blades of each stator unit and of each rotor unit is the same.

11. The downhole tool according to claim 1, wherein each said at least one stator unit is connected to the pump housing and is held stationary in relation to a shaft driven by the driving unit.

12. The downhole tool according to claim 11, wherein the pump housing has at least one opening into which part of the stator unit projects.

13. The downhole tool according to claim 1, wherein the rotor and stator units are arranged on a rotatable shaft, the shaft being connected with and driven by the driving unit at a first end and being unconnected and suspended from the driving unit at a second end.

14. The downhole tool according to claim 1, wherein the chamber inlet is connected to a fluid cleaner device comprising means for separating a material, such as debris and formation pieces, from a liquid.

15. The downhole tool according to claim 1, further comprising a driving tool for moving the tool forward in the casing.

16. A system for cleaning a borehole downwell, comprising:

a tool according to claim 1; and a fluid cleaner device connected to the tool.

17. The system according to claim 16, wherein the fluid cleaner device comprises:

a cleaner housing;

a collecting chamber, the collecting chamber being arranged within the cleaner housing;

a cleaner inlet, the cleaner inlet being arranged in a first end of the cleaner housing;

a cleaner outlet, the cleaner outlet being arranged in a second end of the cleaner housing; and a filter, the filter being arranged substantially in the middle of the collecting chamber and configured such that fluid cannot pass through both the cleaner inlet and cleaner outlet without passing through the filter;

wherein the cleaner outlet is configured to be aligned with the chamber inlet of the tool when the cleaner device is connected to the tool and the cleaner outlet is arranged on an opposite side of the filter relative to the cleaning inlet such that fluid entering the tool from the cleaner device will have had to pass through the filter.

18. The downhole tool of claim 1, wherein each stator blade is configured to have a radially projecting fin which is arranged to interact with a respective opening in the pump housing.

* * * * *